US006887025B2

(12) United States Patent
Buhler et al.

(10) Patent No.: US 6,887,025 B2
(45) Date of Patent: May 3, 2005

(54) COMBINED INSERTER AND BINDER FOR WIRE ELEMENT

(75) Inventors: Warren E. Buhler, Poughkeepsie, NY (US); Frank L. Bagrosky, Marlboro, NY (US)

(73) Assignee: Performance Design, Inc., Boise, ID (US)

( * ) Notice: Subject to any disclaimer, the term of this patent is extended or adjusted under 35 U.S.C. 154(b) by 79 days.

(21) Appl. No.: 10/356,374

(22) Filed: Jan. 31, 2003

(65) Prior Publication Data

US 2003/0198536 A1 Oct. 23, 2003

Related U.S. Application Data

(60) Provisional application No. 60/353,511, filed on Jan. 31, 2002.

(51) Int. Cl.[7] ..... B42B 5/10
(52) U.S. Cl. ..... 412/39; 412/9; 270/58.07
(58) Field of Search ..... 412/9, 33, 38, 412/39, 40; 270/58.07, 58.08

(56) References Cited

U.S. PATENT DOCUMENTS

| | | | | | |
|---|---|---|---|---|---|
| 3,451,081 | A | * | 6/1969 | Liouville | 412/39 |
| 3,810,495 | A | * | 5/1974 | Pack | 140/93 A |
| 4,482,279 | A | | 11/1984 | Jones et al. | 412/39 |
| 4,900,211 | A | | 2/1990 | Vercillo | 412/38 |
| 4,902,183 | A | | 2/1990 | Vercillo | 412/7 |
| 4,934,890 | A | * | 6/1990 | Flatt | 412/39 |
| 5,059,078 | A | | 10/1991 | Schmid | 412/39 |
| 5,197,842 | A | * | 3/1993 | Bross | 412/39 |
| 5,253,968 | A | | 10/1993 | Paedae, Jr. | 412/34 |
| 5,370,489 | A | * | 12/1994 | Bagrosky | 412/39 |
| 5,549,433 | A | * | 8/1996 | Byrne | 412/39 |
| 5,855,464 | A | * | 1/1999 | Bennett | 412/39 |
| 5,971,689 | A | | 10/1999 | Scharer et al. | 412/33 |
| 6,074,151 | A | * | 6/2000 | Pas | 412/38 |
| 6,074,152 | A | | 6/2000 | Vecchi | 412/39 |
| 6,079,924 | A | * | 6/2000 | Chiang | 412/33 |
| 6,186,720 | B1 | | 2/2001 | Chiang | 412/16 |

* cited by examiner

*Primary Examiner*—Derris H. Banks
*Assistant Examiner*—J Williams
(74) *Attorney, Agent, or Firm*—Pedersen & Co., PLLC; Ken J. Pedersen; Barbara S. Pedersen

(57) ABSTRACT

A combination inserter and binder machine for wire loop element is easily adjustable for a wide range of diameters of element, preferably without the use of tools or changing of the tool surfaces that perform the closing. The user inserts a stack of punched paper onto a table so that the paper edge slides into the open wire element that is held in place between an upper and lower tool. The upper tool is actuated to move down relative to the lower tool to close the wire element. The surfaces of the upper and lower tools that are presented to the element are preferably V-shaped at an angle or range of angles that are found to be effective for handling the wide variety of diameters. The adjustments made prior to changing to a different diameter of wire ensure that all the paper will slide into the elements smoothly without hanging up or sliding above or below the element. The adjustments also ensure that, when the element is closed, the narrow loops will close to the proper extent and through the holes of the paper.

14 Claims, 19 Drawing Sheets

136°
.156
(.312)

44
(.050)

40
Spaces for Book Stops

40

40

40
44

(left front perspective)

(right end, cross-sectional)

(close-up, closing region)

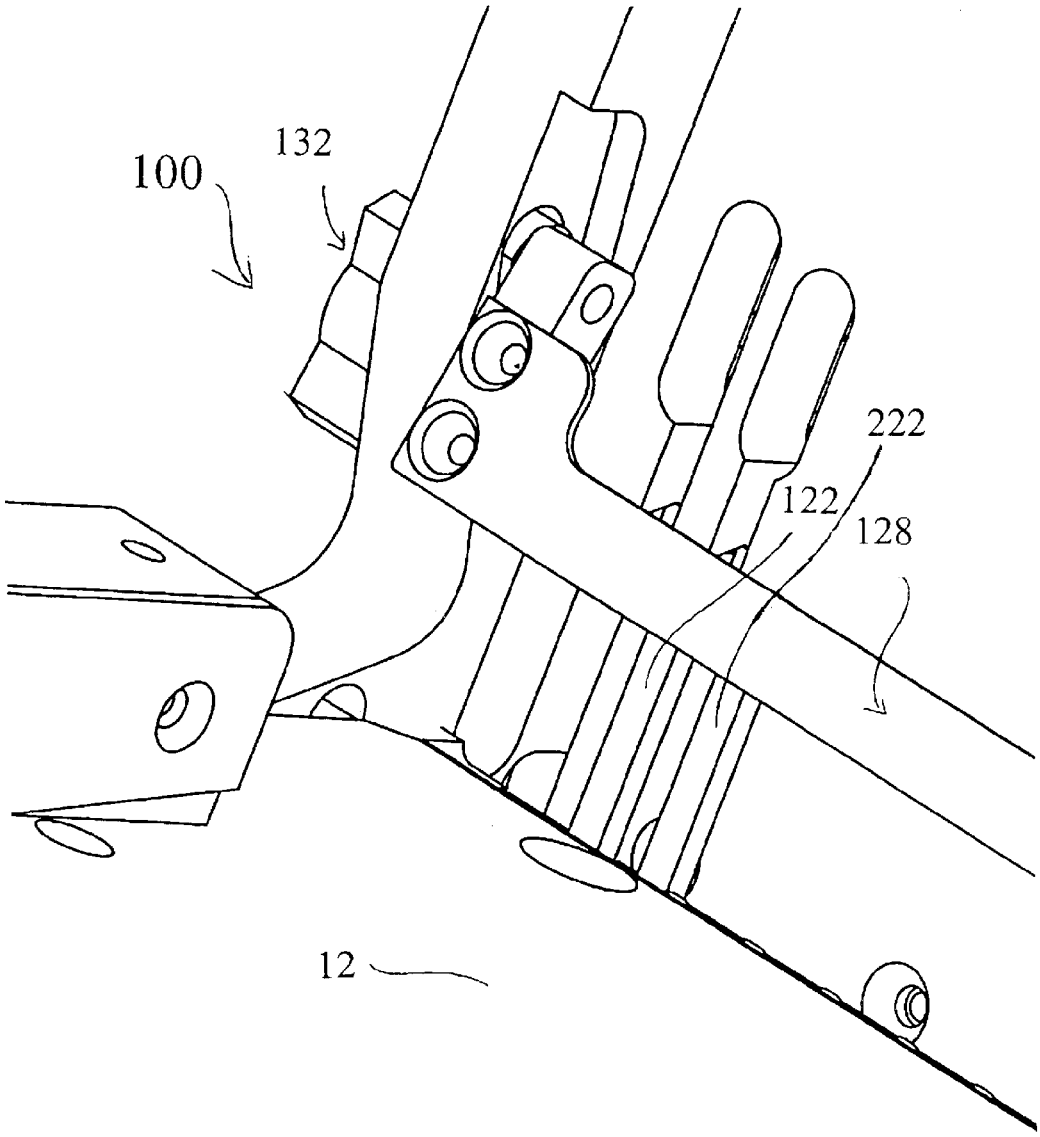
Figure 16
(perspective, front right)
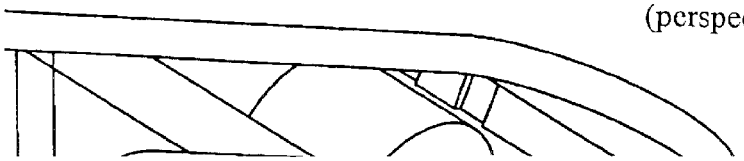

(rear view)

COMBINED INSERTER AND BINDER FOR WIRE ELEMENT

DESCRIPTION

This application claims priority of provisional application Ser. No. 60/353,511, filed Jan. 31, 2002, entitled "Combined Inserter and Binder for Wire Element," the disclosure of which is herein incorporated by this reference.

BACKGROUND OF THE INVENTION

1. Field of the Invention

The present invention relates, generally, to inserters and binders for wire element of the type used to bind stacks of paper into booklets and pamphlets. More specifically, this invention relates to a combination device that serves both to insert the loops of a wire element into a punched stack of paper and to close the loops around the paper stack edge to accomplish the binding process. Also, this invention relates to a combination device that is easily adjustable by a user to accommodate various wire element diameters and lengths, for allowing binding of many differently-sized booklets and pamphlets.

2. Related Art

A popular binding element, for reproduction departments of businesses and law firms, graphics and copy shops, and schools and universities, is the wire element commonly referred to as "double loop," "Double-O," or "looped wire" element. This wire element is an elongated, single piece of wire that is formed/bent into a particular shape, represented by FIGS. 1A, 1B, and 1C (Prior Art, not to scale). FIG. 1A schematically illustrates a popular wire element, which is a relatively small diameter wire element of approximately ¼ inch diameter when closed, and approximately 4 narrow loops (N) per inch and approximately 3 wide loops (W) per inch. FIG. B1 illustrates a larger diameter wire element, of approximately ½ inch in diameter when closed, approximately three narrow loops (N) and two wide loops (W) per inch. A rear perspective view of the larger diameter element is shown in FIG. 1C, wherein it is seen that the loops form a C-shape with an opening into which the paper stack is inserted. In order to use wire element, a paper stack is inserted into the wire element, with the paper holes properly lined up with the narrow loops, and the element is forced to close so that the ends of the narrow loops are near to, and in between, the wide loops. This process is well known in the binding art.

FIGS. 1D–1F illustrate various results of the binding process that may occur, depending upon the accuracy of the process. FIG. 1D illustrates the preferred "even close," with the narrow loops touching and aligned accurately in between the wide loops so that the narrow loops curve at generally the same diameter as the wide loops. FIG. 1E illustrates an "over close," with the narrow loops extending out over the wide loops at a greater diameter than the wide loops. FIG. 1F illustrates an "under close," with the narrow loops extending inside the wide loops at a smaller diameter than the wide loops. Typically, both the over and under closures result in the narrow loops not touching the wide loops, with resultant gaps between the narrow and wide loops through which may fall out one or more paper sheets.

Conventionally, various methods and devices have been developed for inserting paper into wire element, with one of the more reliable but time-consuming methods being a person manually "hanging" the stack of paper on an open wire element that is fixed in position. After the person hangs the paper stack on the element, then the combination of element plus paper is moved to a closing device, in which typically a flat bar moves against the element to close the narrow loops against and between the wide loops.

Examples of prior art closing devices for wire binding elements are shown in patents such as Bennett (U.S. Pat. No. 5,855,464), Flatted (U.S. Pat. No. 4,934,890), and Leoville (U.S. Pat. No. 3,451,081) and Bagrosky (U.S. Pat. No. 5,370,489).

Still, the instant inventors believe there is needed an improved system for handing such insertion and binding processes. There is needed an economical and reliable combination device that does both insertion of wire element into paper holes and closes the element in a substantially automatic or semi-automatic operation. Such a device is needed that is easily adjusted for various sizes/types of element, so that a single machine can be used by a copy or print shop for many different binding jobs. The present invention meets these needs.

SUMMARY OF THE INVENTION

The present invention comprises a machine for binding papers or other media with wire loop element ("wire element"). The machine may be adjusted, without changing the tools that perform the closing of the wire element, to insert and close wire element of various sizes and types in various stacks of media. Because many different wire elements are used in a print or copy shop, such as different diameters, and different total lengths, an objective of the invented machine is to be adaptable to many of these different wire elements by turning adjustment knobs or other controls, but preferably not by replacing any tools or other parts in the machine. Another objective of the invention is to provide a inserter and binder machine that is sized and priced appropriately for a smaller business, print shop, or school that cannot make the major investment in funds and size that a large industrial scale closing machine requires.

The invented machine comprises a closing region, which is the region into which the selected wire element is placed, and the region into which the already-punched stack of paper or other media is placed. Proper placement of the wire element and the paper, relative to one or more provided stops or reference members, results in the paper holes being properly aligned with the narrow loops of the element.

In the region where the wire element and the punched paper edge are located, the invented machine comprises a tool system for inserting the narrow loops of the wire element into the punched holes and closing the wire element. The tool system includes one or more generally concave tools for contacting the wire element and forcing it closed by relative movement of the tools. Most preferably, there are two tools, which are an upper movable tool and a lower stationary tool. The preferred tools are each generally V-shaped, and so can receive generally circular wire loops of many different diameters by providing support to/contact with both the front portions of the loops and the rear portions of the loops. Each of the two tools contact the selected wire element (of various diameters and loops per linear inch) along two lines of contact parallel to the longitudinal axis of the wire element.

During use of the preferred embodiment, the wire element is placed in the closing region, between the upper tool and the lower tool, with the narrow loops near the upper tool and the wide loops near the lower tool. The punched paper stack edges are also inserted in the closer region against book stops without the paper stack contacting or hanging on the wire element but with the paper stack edge extending into the "jaw" of the open wire element. When the machine closing action is actuated, the upper tool preferably moves downward toward the lower tool and, in doing so, squeezes downward on the wire element.

Preferably, the lower tool surface is roughened, so that the wire element frictionally engages the lower tool, resulting in little or no movement of the wire element relative to the lower tool during closing. Preferably, the upper tool surface is smooth, so the there is little or no frictional engagement of the wire element against the upper surface, allowing the narrow loops to slide forward along the upper tool surface as the upper tool forces generally downward against them. The net result of this process is that the upper tool forces the element to bend to place the narrow loops in the proper closed position. Upon release or further movement of the actuation member or other control member, the upper tool moves upward, away from the closed element, allowing a user to remove the bound booklet.

The preferred machine comprises an adjustment system that includes a plurality of adjustment mechanisms for tuning the machine for use with different elements and booklet sizes. The adjustment mechanisms are done by easily-operated controls, such as accessible knobs, dials, or sliding members at the outside of the machine and they preferably do not require tools or disassembly of the machine.

BRIEF DESCRIPTION OF THE DRAWINGS

FIGS. 9*a–f* illustrate various views of one embodiment of the lower tool of FIGS. 7 and 8, wherein: FIG. 9*a* is rear perspective view of the lower tool embodiment. FIG. 9*b* is an end cross-sectional view, as viewed along the lines 9*b*—9*b* in FIG. 9*c*. FIG. 9*c* is a front view of the lower tool. FIG. 9*d* is an end view of the lower tool. FIG. 9*e* is a top view of the lower tool. FIG. 9*f* is a rear view of the tool, with the v-shaped tool surfaces pointing downward in the figure.

FIG. 11*a* is a perspective view of the upper tool. FIG. 11*b* is a partial end view of the tool-end of the upper tool. FIG. 11*c* is an end view of the upper tool. FIG. 11*e* is a front view of the upper tool, with the tool surface point upward in the figure. FIG. 11*f* is a bottom view of the upper tool, showing the tool surface.

FIGS. 13–17 are views of an alternative inserter and binder device according to the invention.

DESCRIPTION OF THE PREFERRED EMBODIMENTS

Figure 1A:
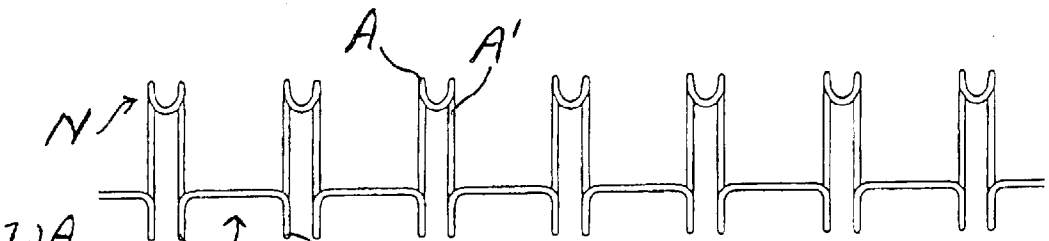
PRIOR ART FIG. 1A
FIG. 1A and FIG. 1B are front views of two diameters of prior art, standard wire element, that is, a large diameter and a small diameter, respectively.
Figure 1B:
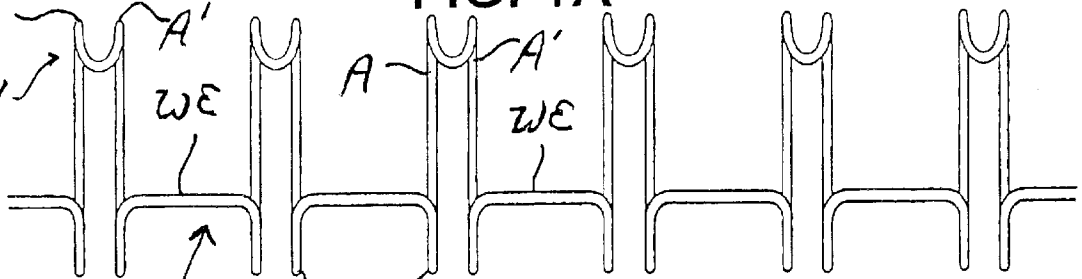
PRIOR ART FIG. 1B
Figure 1C:
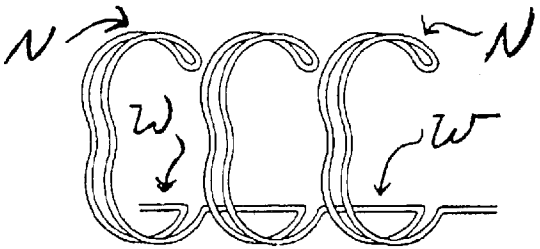
PRIOR ART FIG. 1C
FIG. 1C is a rear, perspective end view of an element such as the type shown FIGS. and 1A and 1B.
Figure 1D:
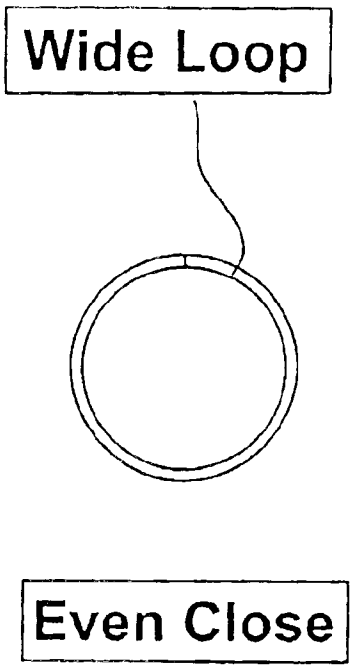
FIG. 1D is a schematic end view of a wire element closed so that there is little or no gap between the narrow loops and the wide loops, in a proper "even close."
Figure 1E:
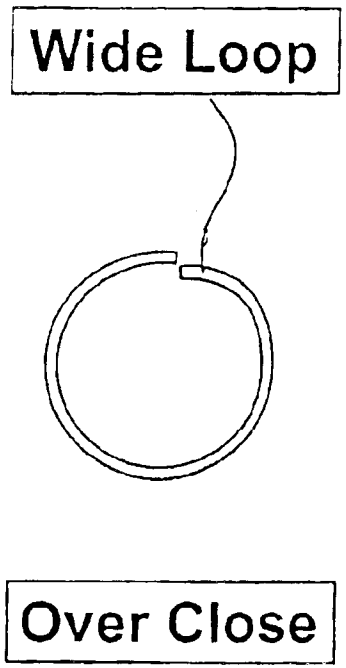
FIG. 1E is a schematic end view of a wire element closed so that the narrow loops are outside the wide loops, resulting in a gap characteristic of the "over-close" situation.
Figure 1F:
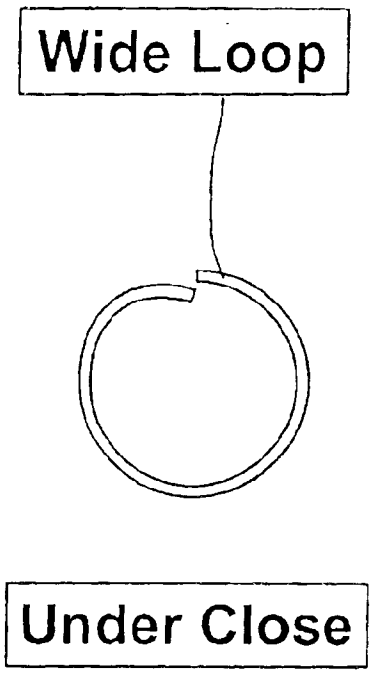
FIG. 1F is a schematic end view of a wire element closed so that the narrow loops are inside the wide loops, resulting in a gap characteristic of the "under-close" situation.
Figure 2:
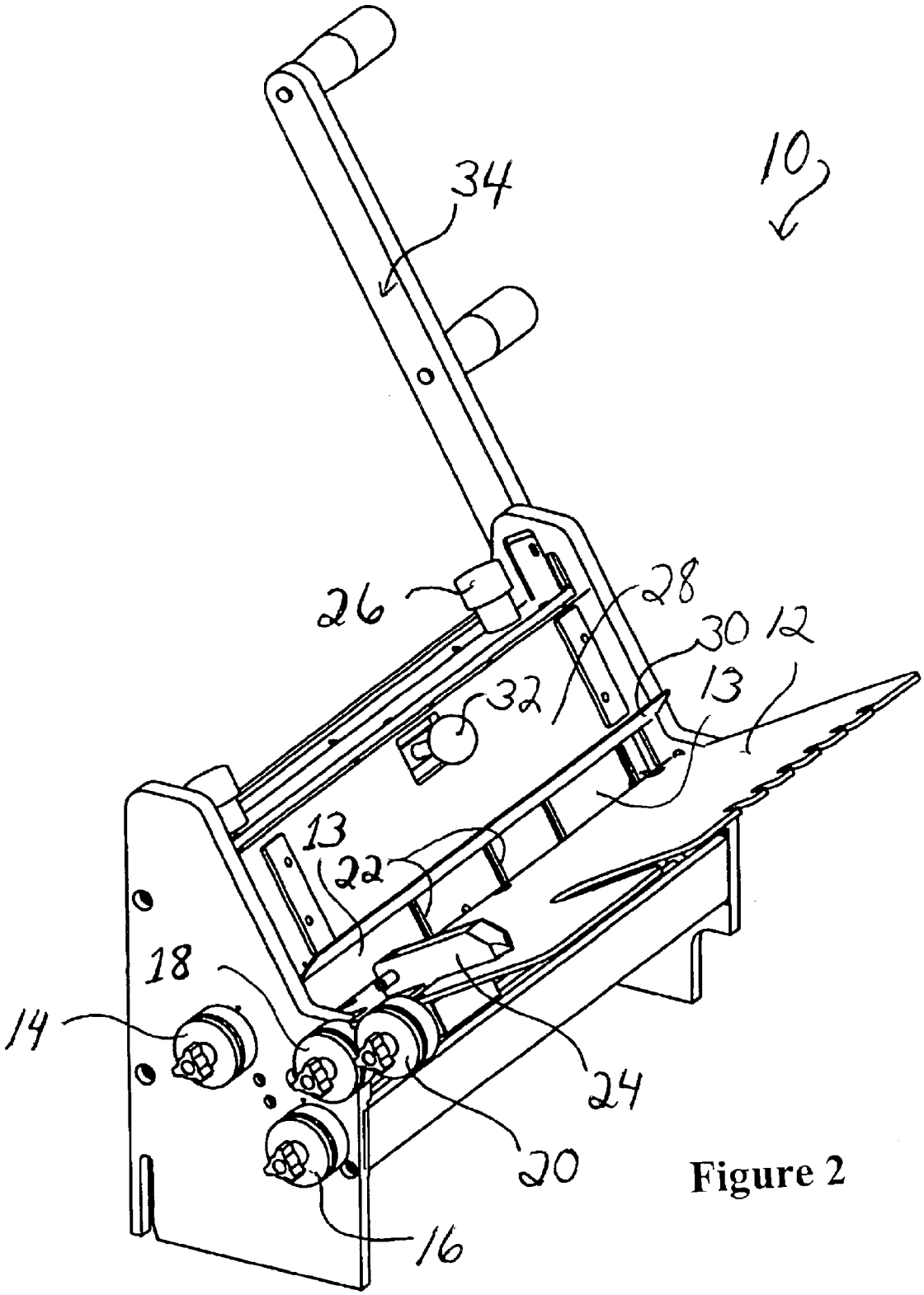
FIG. 2 is a front, left perspective view of one embodiment of the invented machine.

Referring to the Figures, there are shown and described some, but not the only, embodiments of the machine 10, 100 made and operated according to the invention. In FIG. 2, there is shown the preferred embodiment of the inserter and binder machine, hereafter referred to as the "machine" 10. Some of the elements of the preferred machine 10, which are described above in the Summary of the Invention or in the attached Appendix A of patent application Ser. No. 60/353,511, filed Jan. 31, 2002, incorporated herein, are listed as follows:

Table 12 for paper stack or "book"; wire (element) rest 13; adjustment knob for wire rest 14; book (stack) stop knob 16; table height knob 18; book (stack) guide knob 20; book stops 22; book guide 24; closing bar (upper tool) adjustment knob 26; upper wire guide 28 with bent bottom end 30; upper wire guide adjustment knob 32; closing bar handle 34; "closing bar" or upper tool 40; surface of upper tool 44; lower tool 60; surface of lower tool 66; scallops 62 and scallop holes 64; twin book stops 122, 222; rear edge of table 112.

The preferred upper and lower tools are shown in FIGS. 9*a–f*. The surface of each of the two tools that contacts the wire element is preferably an elongated V-shaped trough, wherein two planes of each trough join at a centerline at an angle. The preferred angle is in the range of about 110–150 degrees and more preferably in the range of 130–141 degrees. An especially-preferred angle for many wire elements is 136 degrees.

The invented closing system with its V-shaped tools, is uniquely adapted to properly close many different diameters of element. The element is properly held in position on the lower tool so that the wire element does not move relative to the lower tool, even though the element preferably only contacts the lower tool in two places (at "L" in FIG. 10).

Figure 10:
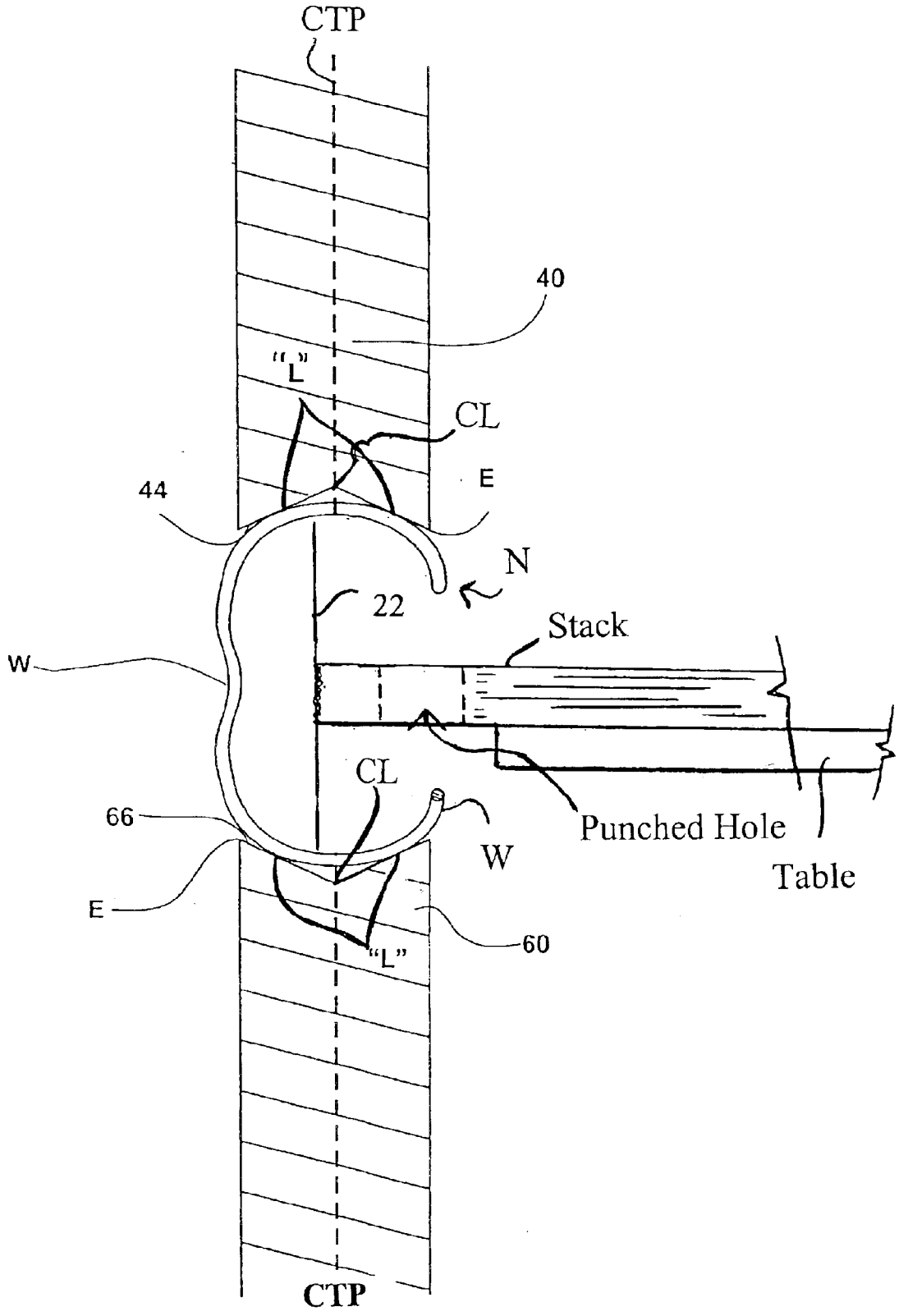
FIG. 10 illustrates a partial end view of a wire element "W" between the upper and lower tools, illustrating the places (longitudinal lines "L") where the V-shaped tools contact the element.
Figures 11A, 11B, 11C, 11D, 11E, 11F:
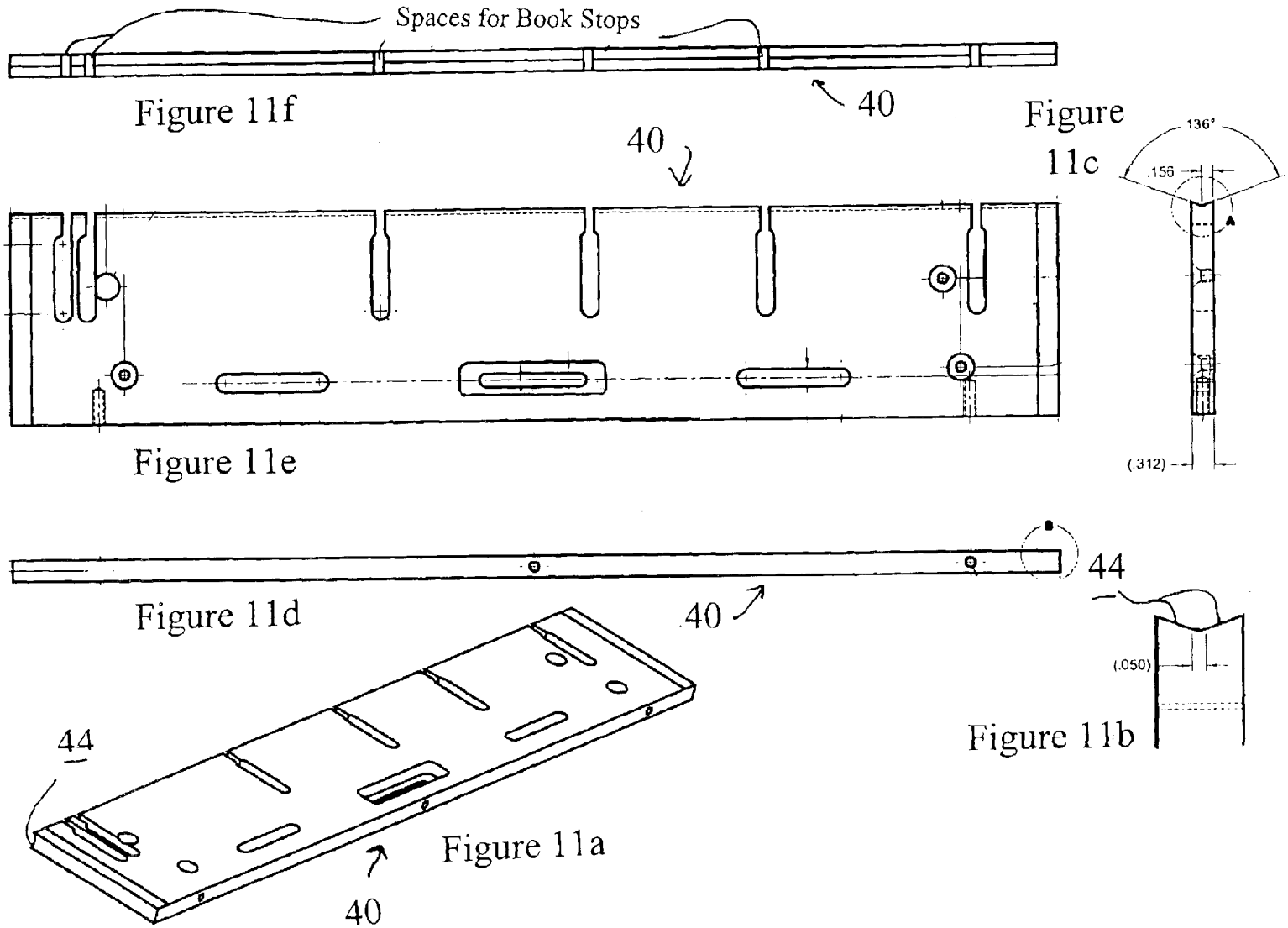
FIGS. 11*a–f* illustrate various views of the movable closing plate, that is, the upper tool.

FIG. 10 schematically shows a wire element "W" on a lower tool 60. Each of the narrow loops (N) arms is preferably contacted in two places, near its front and near its rear, on each of the narrow loop's arms (A, A'). Each of the wide loops is preferably contacted in two places, near its front and near its rear, on each of the wide loop's arms (WA, WA'). Thus, one may say that there are only two contact points "L" (actually, longitudinal lines of contact) of the wire against each of the tools. The V-shape of each tool may accommodate many different diameters of wire element, as the location of those lines (L) of contact are simply in different locations on the surface of the tool, but the tool still effectively grips the element (in the case of the lower tool) and still effectively forces the element (in the case of the upper tool).

The tool surfaces 66 of the lower tool 60 are preferably significantly roughened to grip and hold the wire element. Preferably, the surfaces 66 are have a rough coating applied to them, such as a flame-sprayed metal coating, which is very durable and reliable.

Also, importantly, a single set of V-shape tools of the preferred dimensions has been found to perform excellent and precise closing with a wide range of diameters, as described in Appendix A of the incorporated patent application Ser. No. 60/353,511, filed Jan. 31, 2002, even though surprisingly, the various wire elements C-shape form rest on different areas of the V-shape because of the different size of the "C" relative to the V-shape. The especially preferred version of tool for ¼–9⁄16 diameter wire has been found to have an obtuse angle of 136 degrees and a width of 5⁄16 inch. Preferably, a range of about 133–139 degrees will still be desirable, or even wider ranges are described elsewhere in this Description. The distance from centerline CL to the edge E of the tool surface, as shown in FIG. 10, is preferably 0.156 inches for most, but not necessarily all, embodiments.

Figure 5:
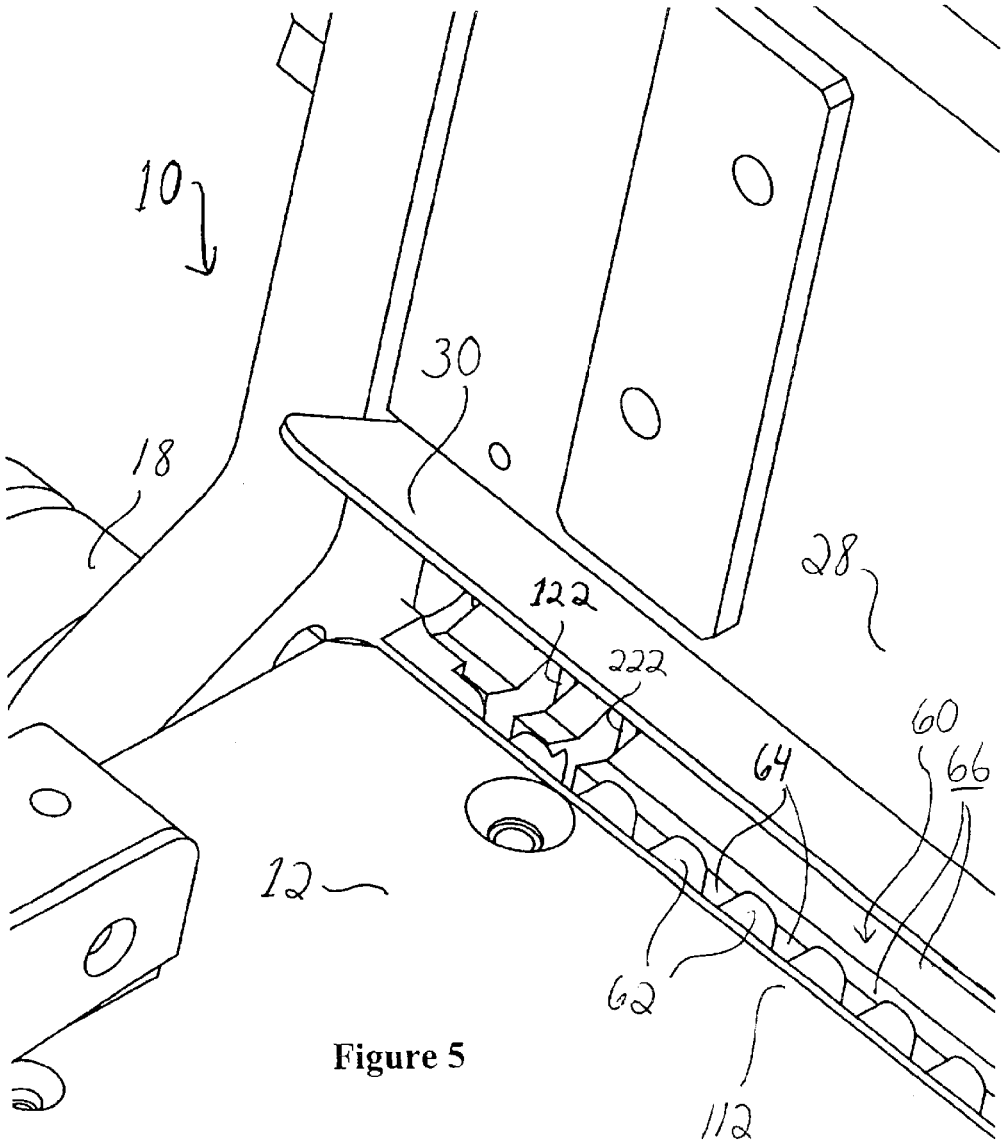
FIG. 5 is a perspective close-up view of the closing region, showing the table rear edge, the lower V-shaped tool, scallops and scallops spaces in front of the lower tool, the twin book stops that serve at reference points for the wire loop, and the bottom guide end of the upper wire guide.
Figure 6:
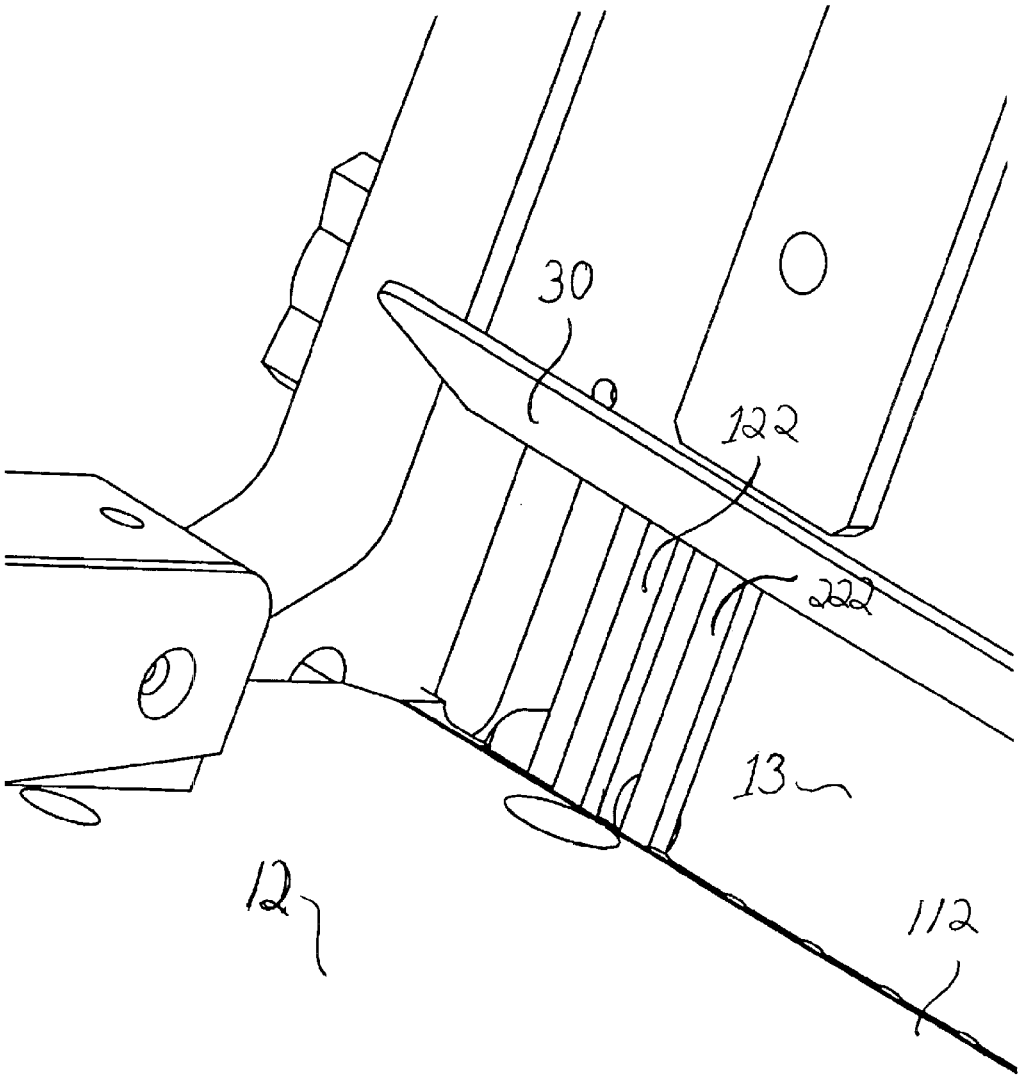
FIG. 6 is a perspective close-up view of the closing region of FIG. 5, viewed from a lower perspective so that the lower tool and scallops are substantially hidden.
Figure 6:
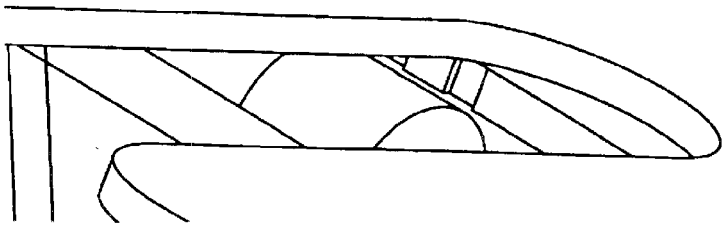
Figure 7:
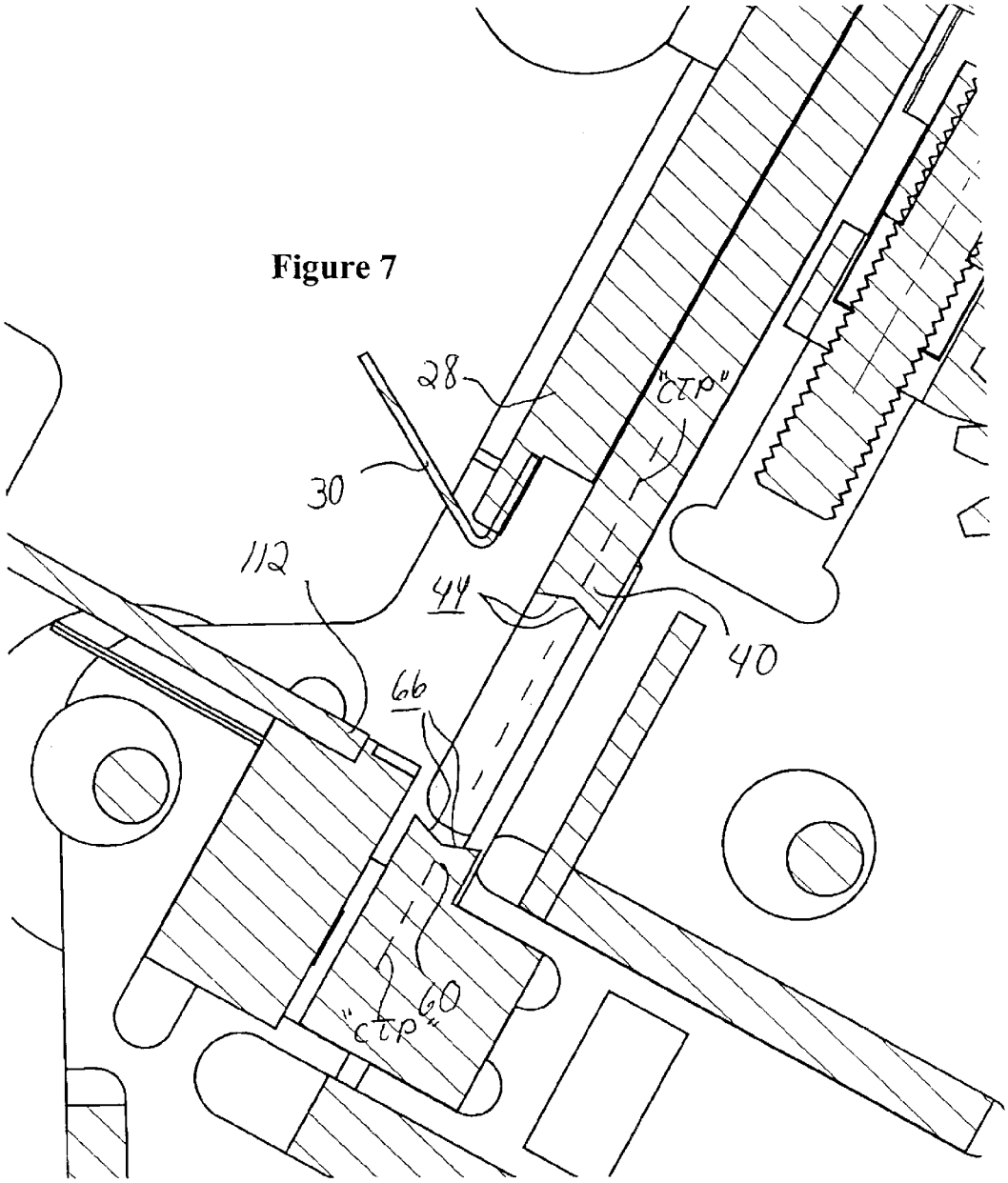
FIG. 7 is a close-up, cross-sectional right view of the closing region, with the tools opened, that is, the upper tool raised away from the lower tool, and illustrating the centerline plane of the tools "CTP".
Figure 8:
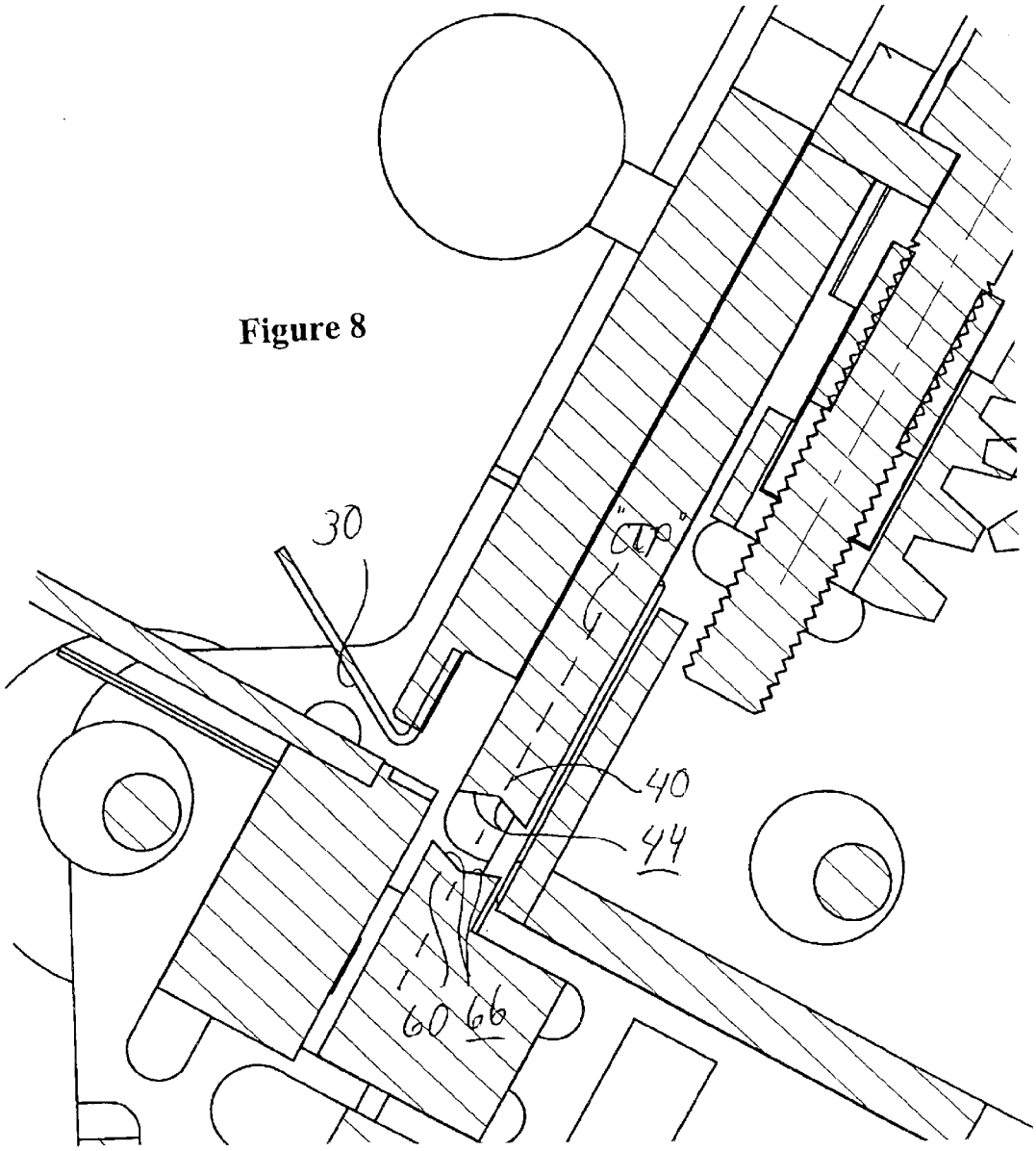
FIG. 8 is a view of the closing region, with the tools closed, that is, the upper tool lowered toward the lower tool, and illustrating the centerline plane of the tools "CTP," which remains the same at all upper tool positions.

Scallops 62 and their corresponding holes/spaces 64 between scallops are shown to best advantage in FIG. 5. These spaces between the scallops leave room for the narrow loops being forced downward in between the wide loops of the wire element.

Figure 9B:
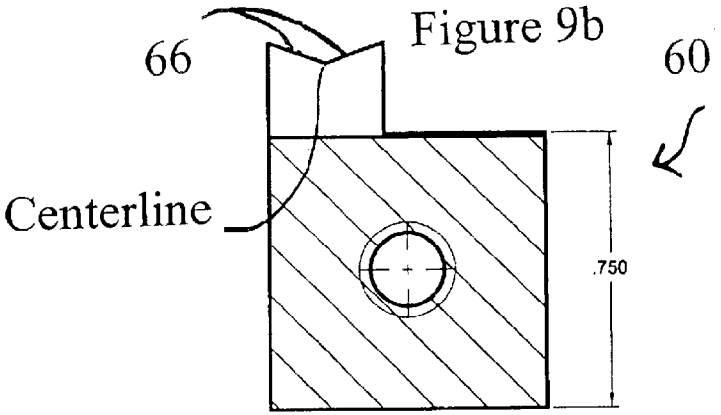
Figure 9A:
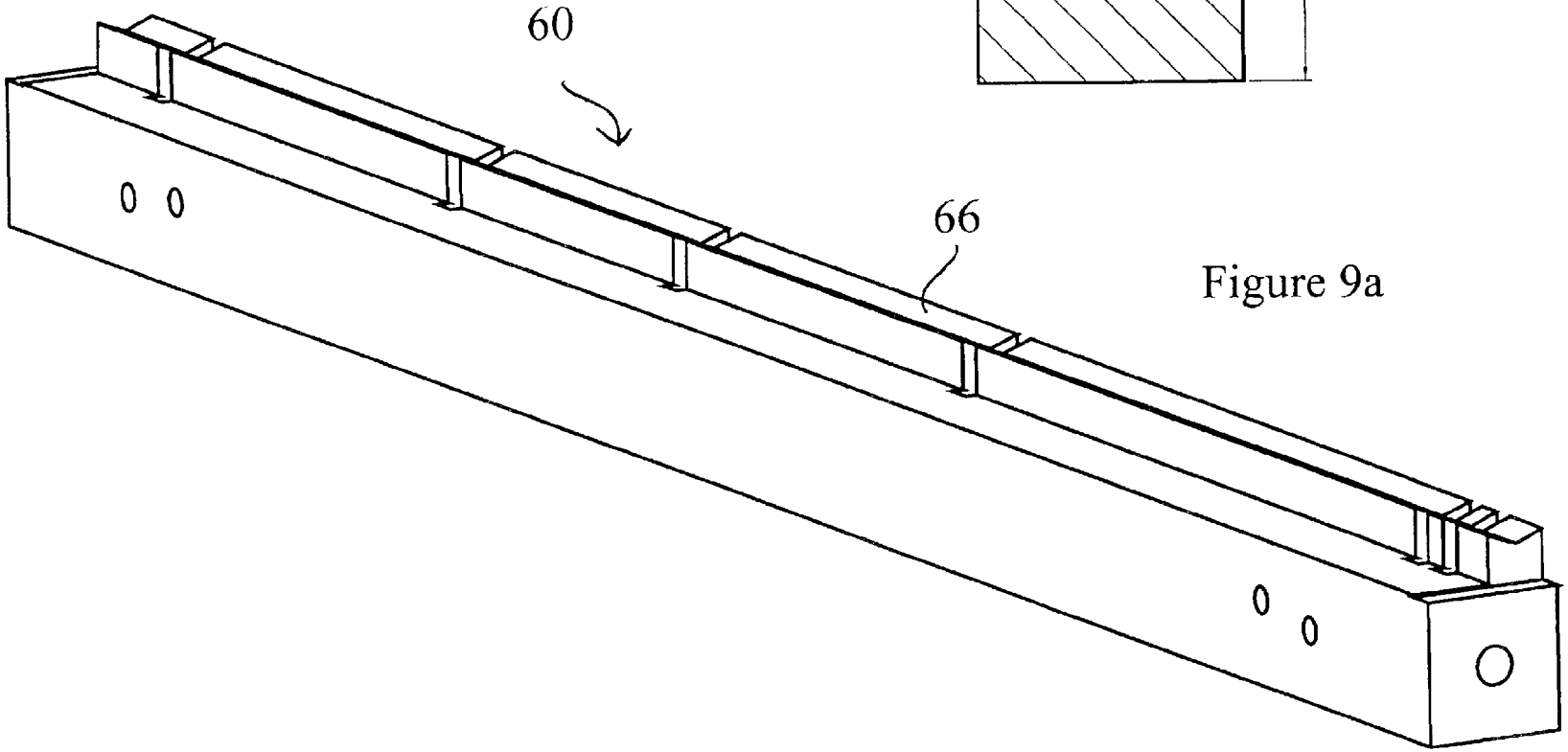
Figures 9C, 9D, 9E, 9F:
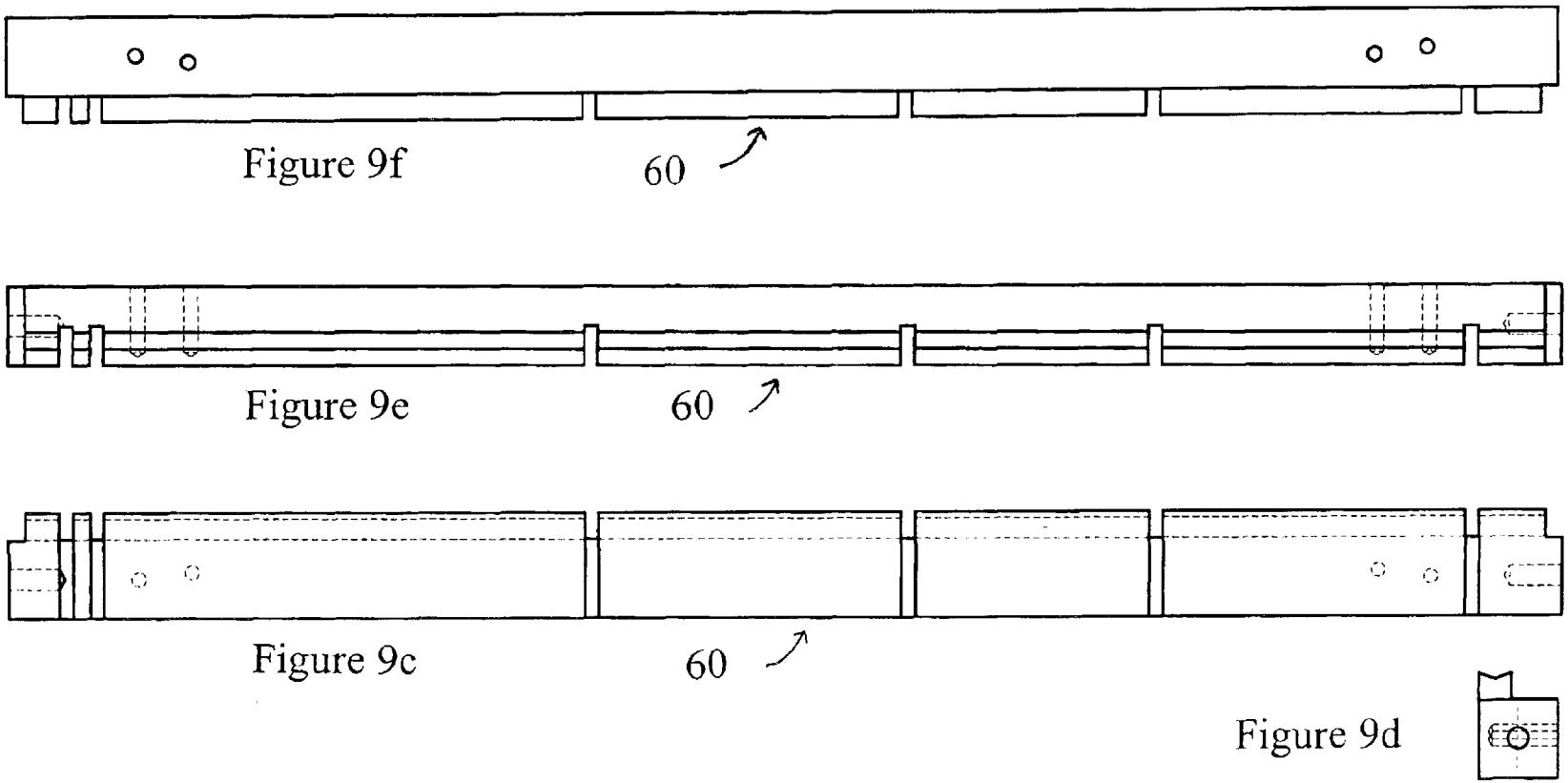

Channels in the tool members for the book stops are shown in FIGS. 9*a, c, e, f*, and 11*a, e* and *f*. The book stops 22 extend along generally vertical planes that pass through the tool, and so room must be given for the book stops in their variously-adjusted positions. As these book stops 22 limit the rearward movement of the paper edges on the table 12, the book stops must extend generally to near the vertical central plane of the wire elements, and, hence, also near the center plane of the tools, so that the paper holes are positioned properly relatively to the narrow loops of the wire element.

Figure 12:
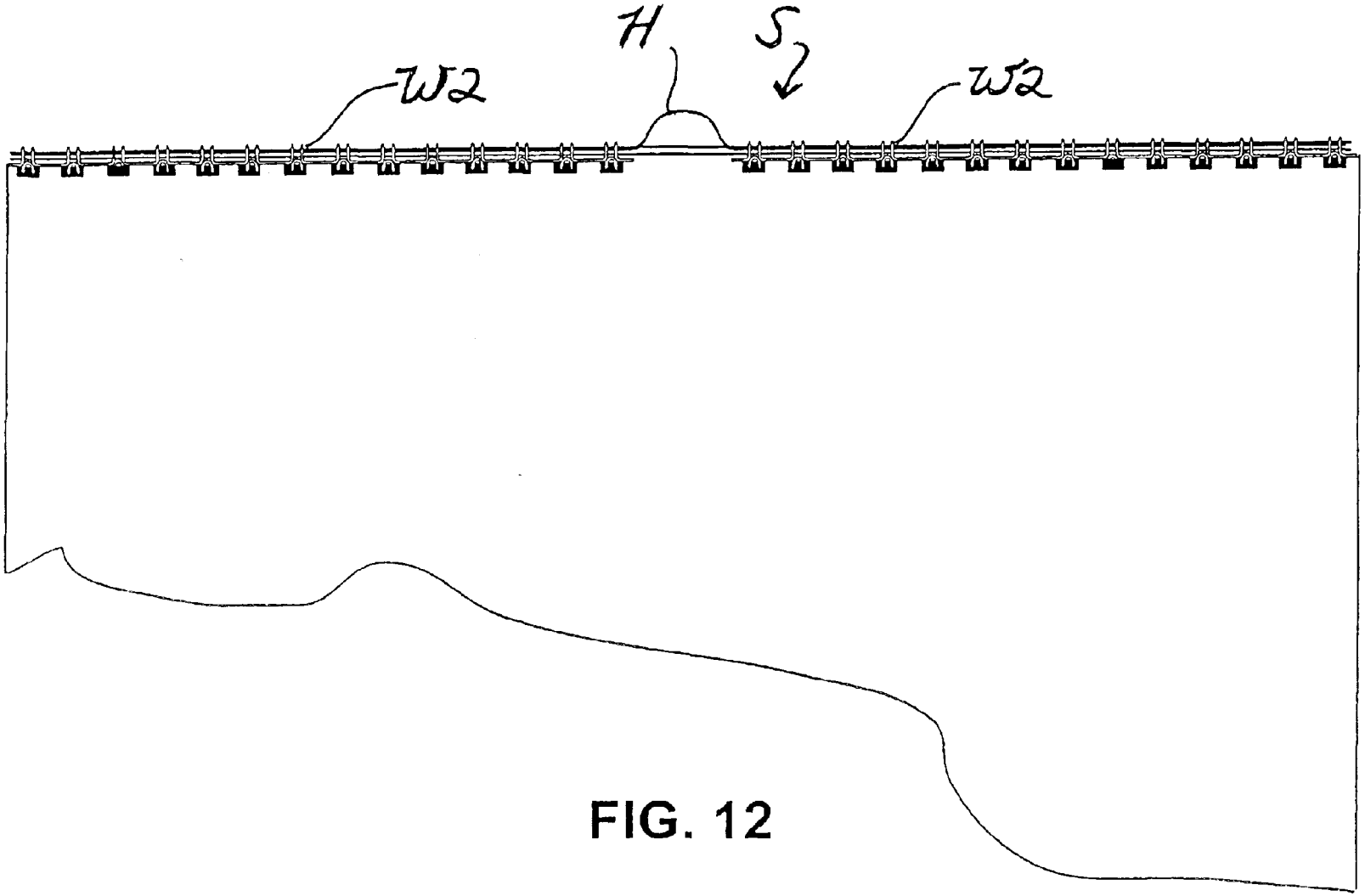
FIG. 12 is a view of a calendar style binding with wire element and a central hook, which may be accomplished with an embodiment of the invention.
Figure 13:
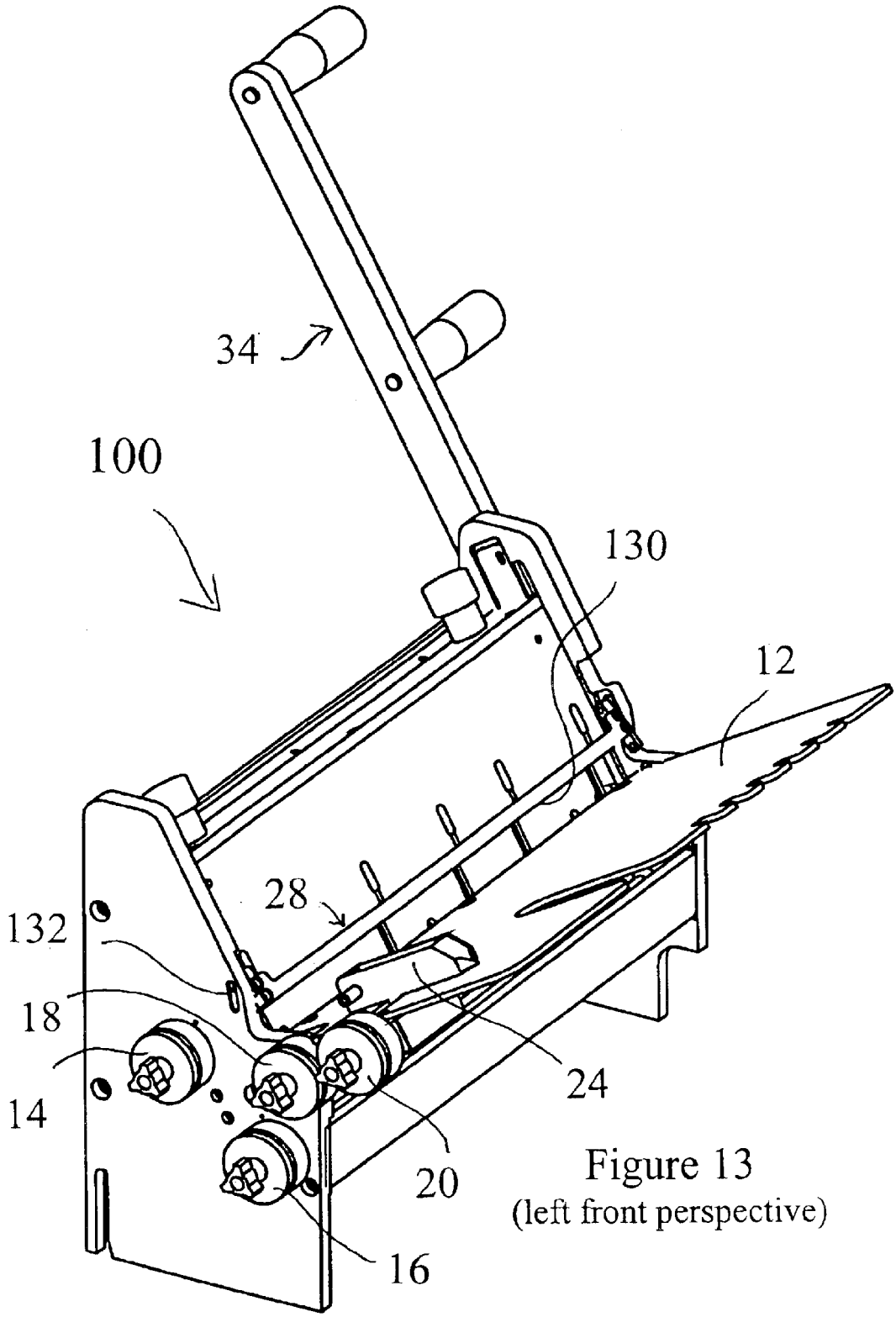
Figure 14:
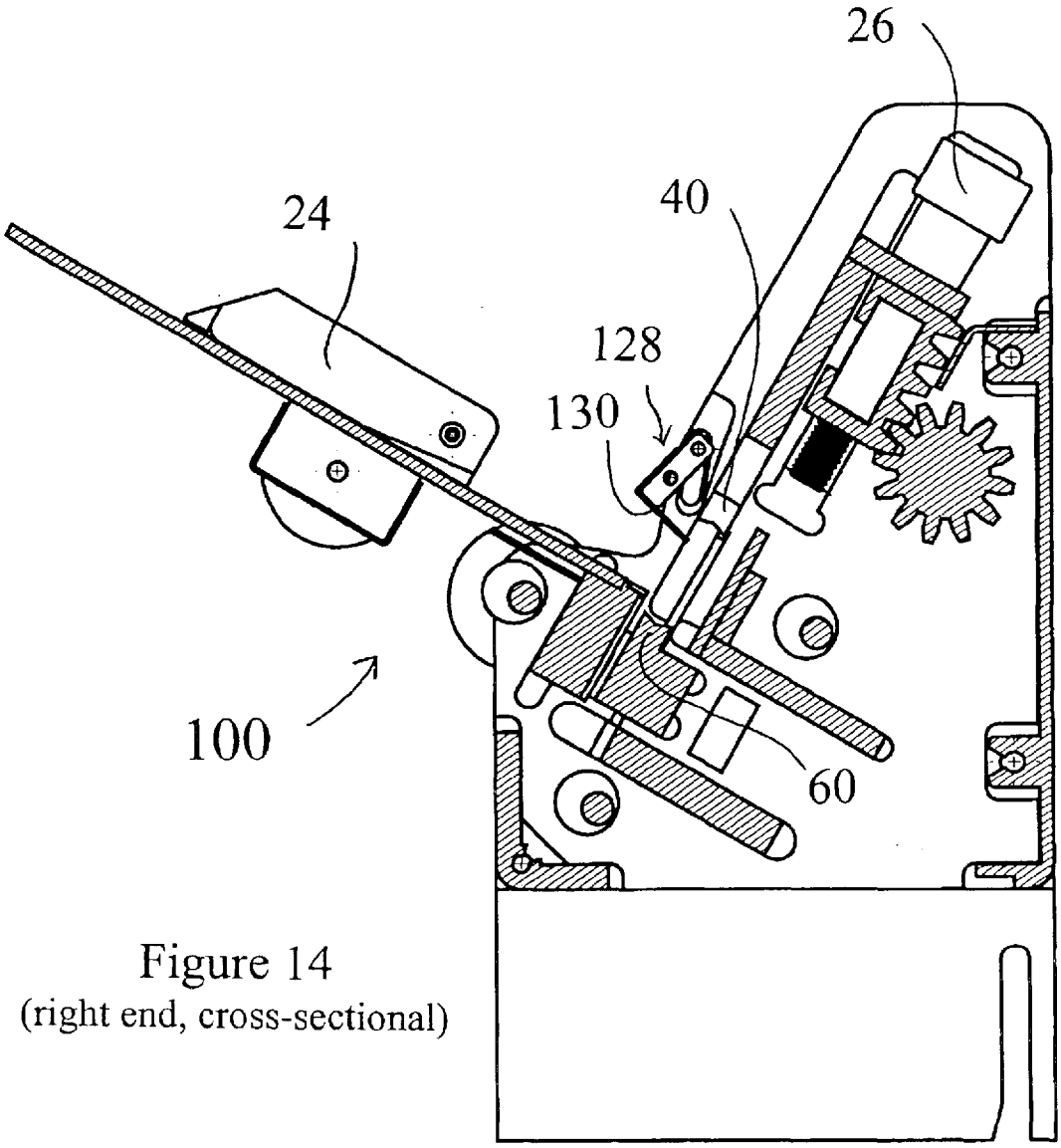
Figure 15:
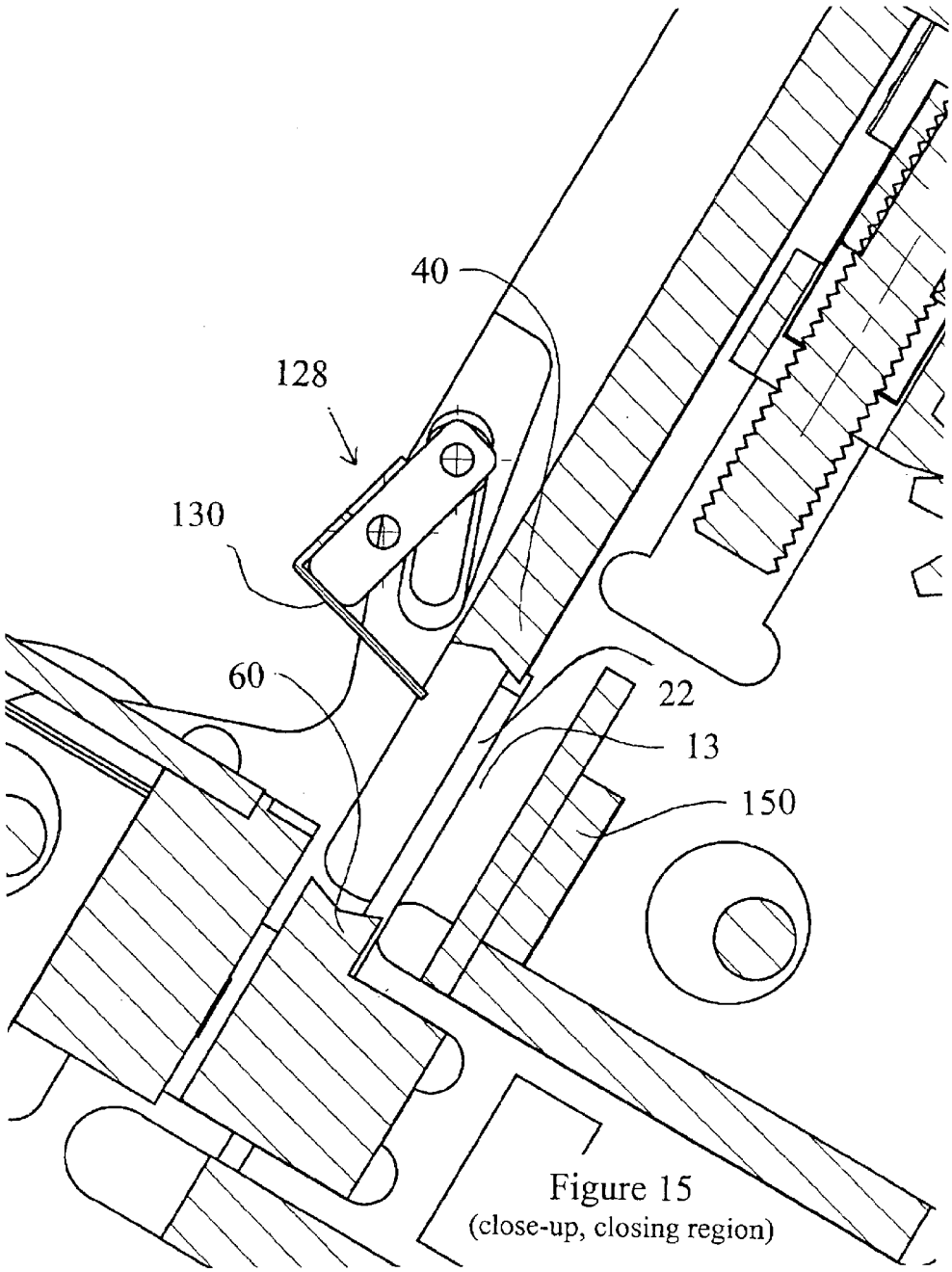
Figure 17:
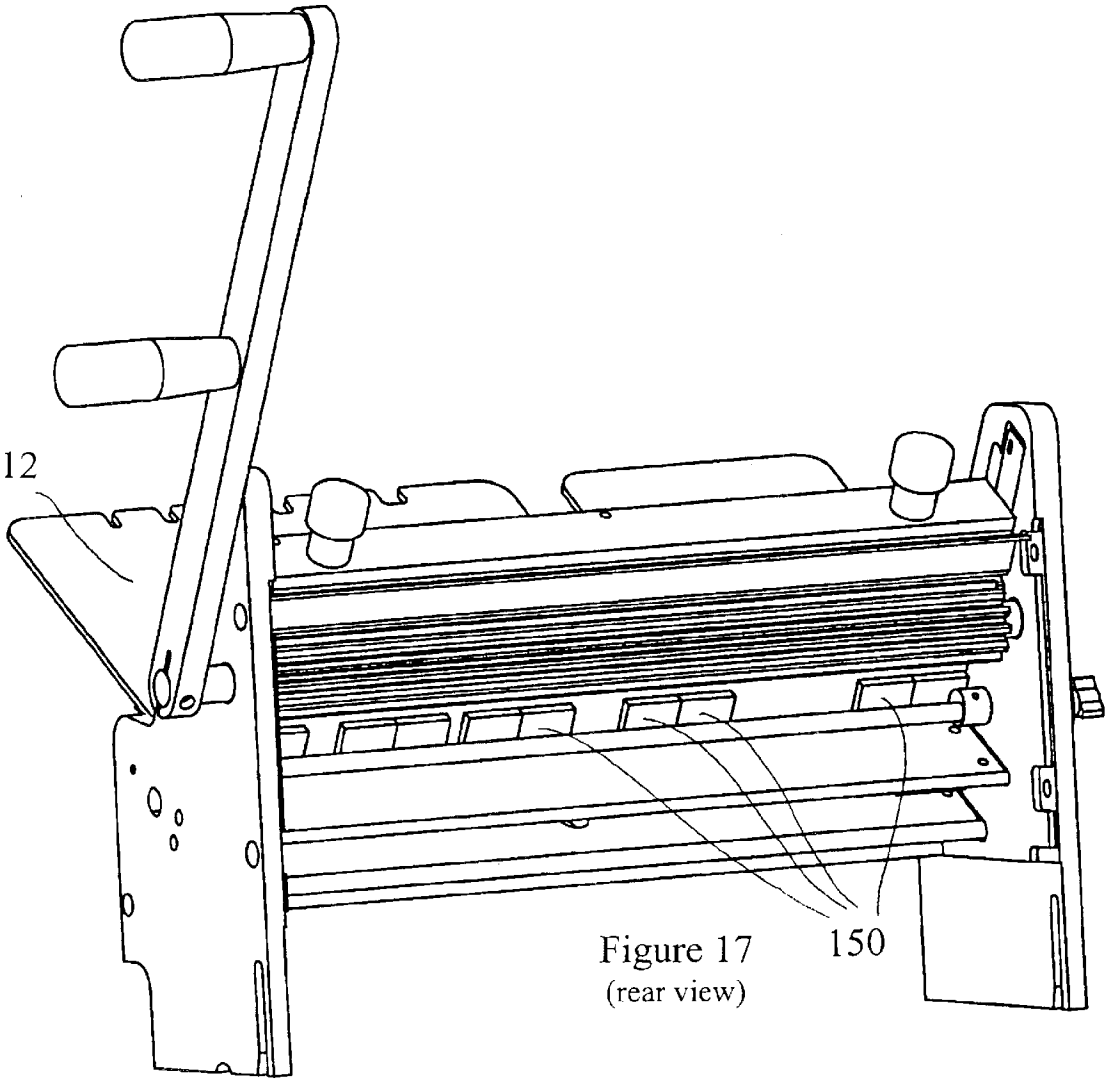

A single machine 10 made according to the preferred specifications may work with ¼ inch–9⁄16 inch diameter element of 3–1 loops/inch (pitch) and another machine with slightly different scallop and scallop spaces and book stop placement may work with ¼–9⁄16 inch diameter and 2-1 inch loops/inch. Yet another machine may be adapted for 3-1 pitch and 18 inch long calendar binding. This calendar version will accommodate two separate (shorter) elements W2 for the two ends of a calendar spine S, resulting in the binding shown in FIG. 12. In this machine, the wire and paper pages are placed relative to a centerline, and room must be left in the structure to accommodate the "hook" H without crushing or crimping it.

Yet a fourth machine may be adapted for very large diameter wire, that is at least 5 sizes from ⅝ inch up to 1.25 inch diameter, with a 2–1 pitch. Such a machine will work generally as described above but the tools will be wider, for example, preferably ⅝ inch wide from edge to edge (rather than the 5⁄16 inch wide dimension shown in FIG. 10. Still, the angle of 136 degrees is preferred for the two halves of the tool surface relative to each other, as this has been found by the inventor to be optimum for the preferred binding process, so the inventor most preferably uses 136 degrees plus/minus 3 degrees.

The adjustments recommended for the various diameter wires are marked on the knobs relative to markings on the housing or other structure of the machine. These are guidelines, however, as some variations will be needed depending on the quality of wire, for example. The preferred tools are 5⁄16 inch from outer edge to outer edge, but this may be adjusted for different binding application such as very large diameter wires.

With the invented tool system and adjustment system, one machine can handle many diameters of wire element of 3-1 pitch without any change-out of the upper and lower tools or any other members. Also, one machine according to the invention can handle many diameters of wire element of 2-1 pitch without any change-out of the upper and lower tools or any other members.

The adjustment system preferably includes the following mechanisms:

Wire Rest Adjustment:

This adjustment moves a plate (13) that is behind the closing region (which plate is generally vertical and preferably parallel to the "centerline plane" (CTP) extending through the centerline of the upper tool and the centerline of the lower tool. The adjustment moves this plate (13) forward and backward to be closer or farther away from the tools, respectively, always keeping the plate parallel to the centerline plane (CTP). This serves to move the "stop" or "backrest" against which the wire element rear side rests when the wire element is placed in the closing region. For larger diameter wire element, the wire rest is move rearward to provide more room for the large wire element.

Book Stop Adjustment:

This adjustment moves a plurality of book stops 22 that extend generally vertically just to the rear of the tools (40, 60) and spaced apart so that wire loops will rest between them. Adjustment of these book stops 22 moves them together forward and backward together, maintaining them parallel to the centerline plane. As shown schematically in FIG. 10, the book stops 22 determine how far forward or rearward the paper stack edge is placed, as the stack edge abuts against the stops 22, and, consequently, the location of the paper holes. Moving the book stops 22 rearward is done for smaller wire elements, because the paper punch holes must align with the ends of the narrow loops father rearward. Moving the book stops 22 forward is done for larger diameter wire elements, because the ends of the narrow loops are farther forward, and, hence, the paper holes must be moved relatively forward.

Table Height Adjustment:

This adjustment moves the table 12, which is the platform upon which the stack of paper is placed with its punched edge in the closing region. This table 12 is at a slight angle to horizontal and about 90 degrees to the centerline plane. The table is raised and lowered, without changing its angle relative to the centerline plane CPT, to move the rear edge 112 of the table upward and downward so that the punched paper edge is raised and lowered relative to the lower tool. For a larger diameter wire element, the table is raised because the wide loops are higher up as they rest in the lower tool, and the punched paper edge must also be higher up in order for it not to abut against and/or get hung up on the wide loops when the paper stack is slid rearward on the table, across the rear edge 112, into the closing region.

Closing Bar Adjustment:

This adjustment, in effect, adjusts the location of the upper tool/closing bar (40) up or down on the centerline plane. This adjustment determines how low the final location of the upper tool is when the closing handle has actuated the upper tool into its lowermost position. For smaller diameter wire element, the upper tool 40 must finish in a lower position during the closing process (closer to the lower tool 60) to fully and properly close the narrow loops to the correct position between and slightly past the very outermost extremity WE of the wide loops. This way, no sheets of paper can slip out of the closed wire element. For larger diameter element, the upper tool must finish the closing process further up from the lower tool, that is, more distanced from the lower tool, because of the overall larger diameter of the element, resulting in the top half of the properly closed element being higher up relative to the lower tool than is the top half of a smaller properly closed element.

The Upper Wire Guide Adjustment:

The upper wire guide is a plate with a curved or bent bottom end that covers the front of the narrow loops of the element prior to closing so that the paper stack does not abut against or get hung up on the narrow loops. The upper wide guide is raised or lowered in this adjustment in a plane parallel to the centerline plane, due to the narrow loops of various diameters of wire element residing at different heights in the closing region prior to closing.

With the table adjustment (up and down) and upper wire guide (up and down) adjustment properly adjusted, paper insertion (toward the rear of the table) is effective and smooth. When the closing bar handle is moved to its intermediate position with the closing bar/upper tool against the wire element (but not applying enough force to do any closing), the upper wide guide simultaneously moves down to the proper position just covering the narrow loops. This way, the closing bar/upper tool holds the wire element firmly relative to the lower tool, the table covers or "shields" the wide loops (in front of the wide loops,) and the upper wire guide covers or "shields" the narrow loops (in front of the narrow loops). When the paper stack is then inserted, the paper edges do not hang up on the wide loops or the narrow loops, and the paper edges do not slide up over the top of the narrow loops or down under the bottom of the wide loops. Then, the closing bar handle is moved to the closing position, the closing bar (upper tool) is forced down on the element to an extent that the element closes into an "even close."

Book Guide Adjustment:

This adjustment moves a book guide laterally on the table, to account for different lengths (lateral distance on the table) of the paper stack.

For particular wire elements, which tend to correspond to particular thickness of paper stacks, a set of adjustments may be pre-determined that result in the best binding and more even closure. These sets of adjustments may be noted on the various adjustments, so that the user may simply look set all the knobs for the particular wire element they are using, and an accurate, even closure will result.

Figure 3:
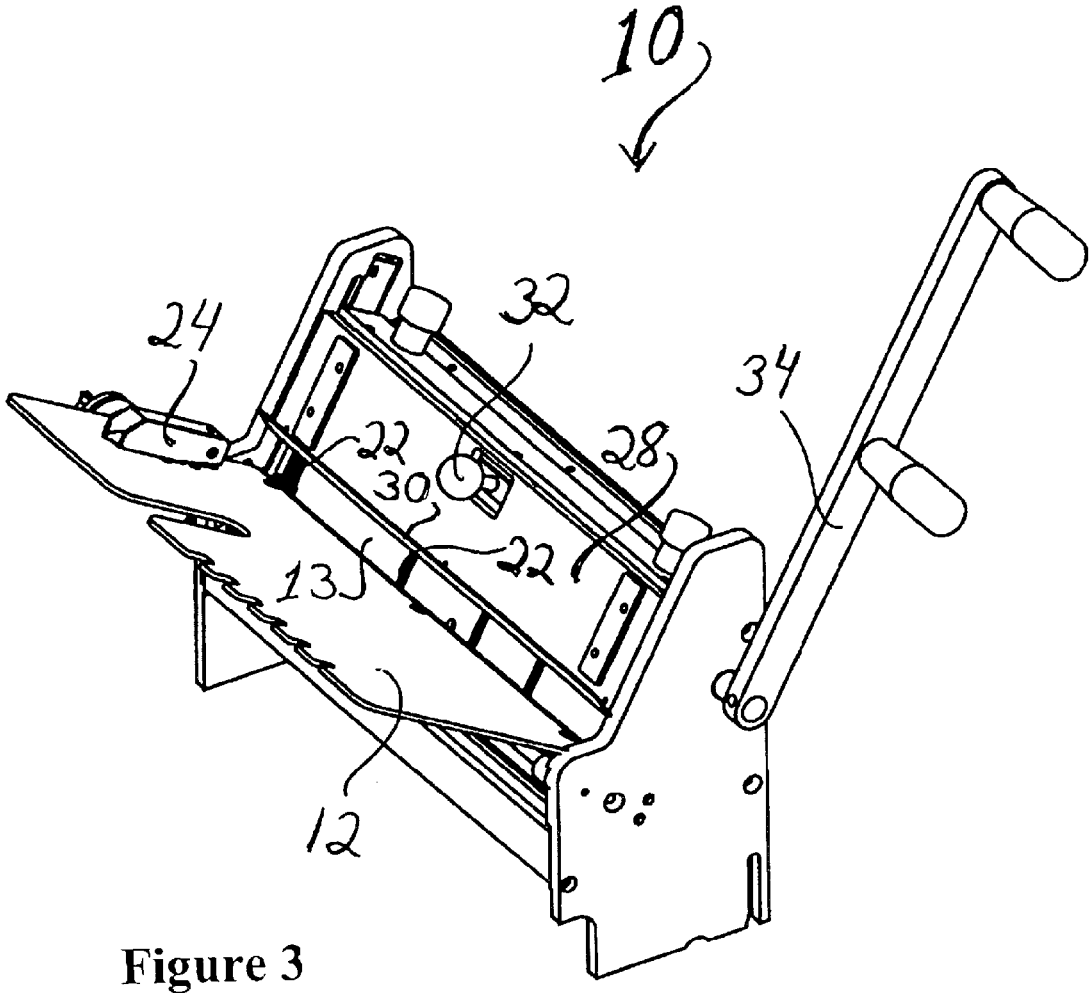
FIG. 3 is a front, right perspective view of the embodiment of FIG. 2.
Figure 4:
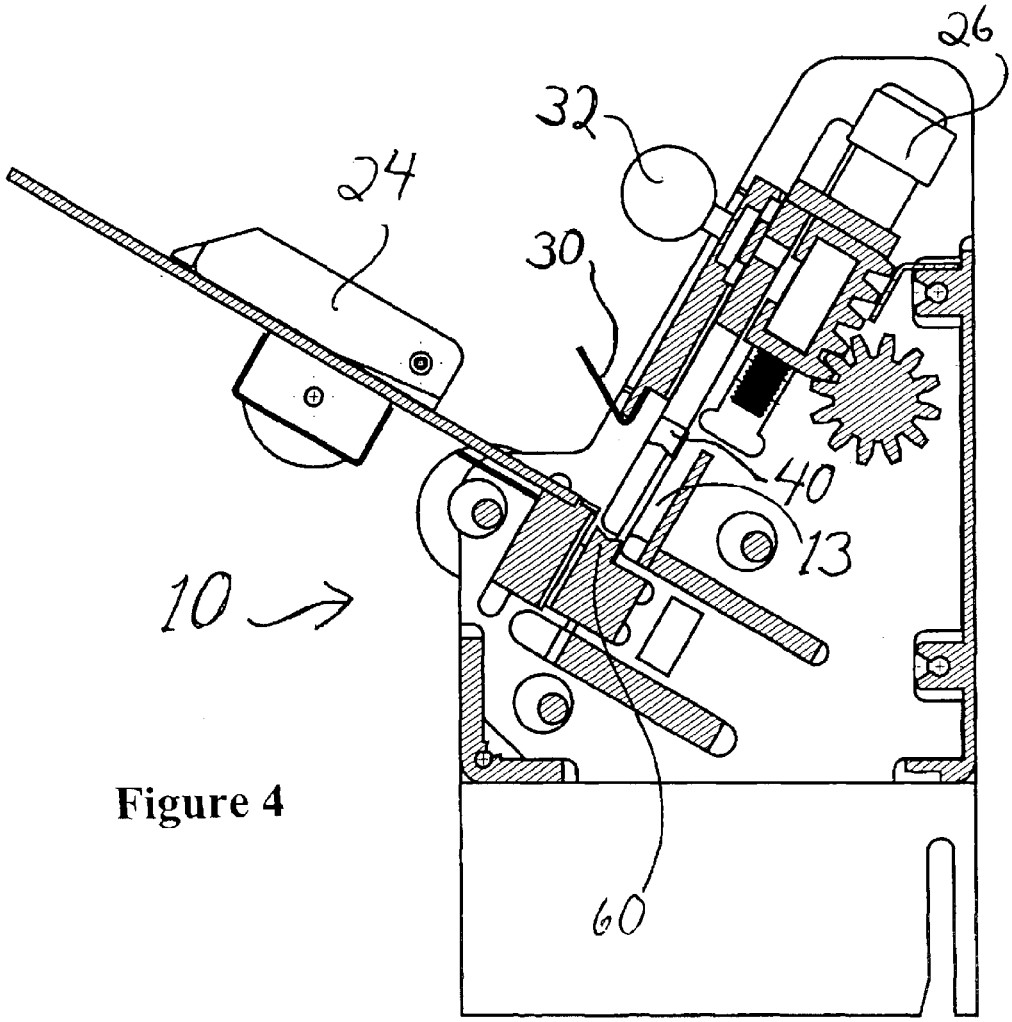
FIG. 4 is a right side cross-sectional view of internals of the machine of FIGS. 2 and 3.

The terms "vertical" and "horizontal" are used in this Description and in the claims, and these terms are meant to describe preferred locations of elements relative to each other. The preferred machine is designed so that closing region and its elements are slightly tilted rearwards, as shown in FIGS. 2–4. This places the table 12 at slight angle relative to true horizontal and the tools and book stops and the other members herein described as "vertical" slightly tilted back from true vertical. Therefore, it should be understood that vertical does not necessarily mean true vertical and horizontal does not necessarily mean true horizontal, but rather these terms refer to relative positioning, so that the "horizontal" and "vertical" elements are generally perpendicular to each other.

An alternative embodiment is shown in FIGS. 13–17, wherein the structure is substantially the same as in the embodiment of FIGS. 2–12, except including an alternative embodiment of the upper wire guide and including magnets near the closing area. The upper wire guide 128 comprises a plate 130 that takes the place of bent bottom end 30, and can be moved by adjustment 132 to cover the narrow loops of the wire element. Magnets 150 are preferably included at various locations along the length of the closing region, for improved positioning and holding of the wire element in place during insertion of the paper stack and during closure. The magnets 150 provide a magnetic force through the wire element rest 13 to urge the wire element rearward against the rest 13 and tend to hold it in a stable manner against that rest during the pre-closing steps of paper insertion and lowering of the upper tool into the intermediate position, and, then, also during the closing step.

The mechanisms for performing the various adjustments and for actuating the closure described herein may be understood by one of skill in the art, after viewing this Description, Drawings, and the claims, especially in view of the disclosure of application Ser. No. 60/353,511, filed Jan. 31, 2002, incorporated herein by this reference.

Although this invention has been described above with reference to particular means, materials and embodiments, it is to be understood that the invention is not limited to these disclosed particulars, but extends instead to all equivalents within the scope of the following claims.

What is claimed is:

1. A combination inserter and binder machine for wire element, the machine comprising:

a platform for receiving media, the platform having a rear edge and a front edge;

a closing region near said rear edge of the platform, the closing region being for receiving a wire element and an edge of the media, the closing region comprising a plurality of tools having tool surfaces adapted to force the wire element through a hole in the media and close the wire element; and an actuation system adapted to cause said tool surfaces to force and close the wire element;

wherein at least one of said tool surfaces is V-shaped; and wherein the closing region comprises a rest plate having a front surface against which said wire element is placed, wherein the rest plate is generally perpendicular to the platform and said rest place is moveable forward and rearward for various diameters of wire element.

2. The machine of claim 1, wherein the V-shaped tool surface comprises surfaces joining at an angle of 110–150 degrees.

3. The machine of claim 1, wherein the V-shaped tool surface comprises surfaces joining at an angle of about 133–139 degrees.

4. The machine of claim 1, wherein the closing region comprises book stops generally parallel to the rest plate and having front surfaces protruding forward relative to the front surface of the rest plate, so that the book stops are adapted to stop the edge of the media froward from the rest plate and forward from the rear of the wire element.

5. A combination inserter and binder machine for wire element, the machine comprising:

a platform for receiving media, the platform having a rear edge and a front edge;

a closing region near said rear edge of the platform, the closing region being for receiving a wire element and an edge of the media, the closing region comprising a plurality of tools having tool surfaces adapted to force the wire element through a hole in the media and close the wire element; and an actuation system adapted to cause said tool surfaces to force and close the wire element;

wherein at least one of said tool surfaces is V-shaped; and wherein said plurality of tool surfaces comprises a lower tool surface adapted to support a bottom surface of said wire element, and an upper tool surface adapted to contact a top surface of said wire element for said forcing and closing, wherein said lower tool surface is adapted to frictionally grip the bottom surface of said wire element.

6. The machine of claim 5, wherein the upper tool surface is smooth so that it is adapted to allow the top surface of the wire element to slide along the upper tool surface during said forcing and closing.

7. A combination inserter and binder machine for wire element, the machine comprising:

a platform for receiving media, the platform having a rear edge and a front edge;

a closing region near said rear edge of the platform, the closing region being for receiving a wire element and an edge of the media, the closing region comprising a plurality of tools having tool surfaces adapted to force the wire element through a hole in the media and close the wire element; and an actuation system adapted to cause said tool surfaces to force and close the wire element;

wherein at least one of said tool surfaces is V-shaped; and wherein the platform is movable upward and downward to raise and lower said rear edge relative to the tool surfaces for adjusting location of the media edge relative to the wire element.

8. A combination inserter and binder machine for wire element, the machine comprising:

a platform for receiving media, the platform having a rear edge and a front edge;

a closing region near said rear edge of the platform, the closing region being for receiving a wire element and an edge of the media, the closing region comprising a plurality of tools having tool surfaces adapted to force the wire element through a hole in the media and close the wire element; and an actuation system adapted to cause said tool surfaces to force and close the wire element;

wherein at least one of said tool surfaces is V-shaped; and wherein the closing region comprises an upper wire guide that is movable up and down to cover an upper portion of the wire element.

9. A method of inserting wire element into a stack of media and closing said wire element in holes of said stack of media, the method comprising:

positioning a wire element between two tools, wherein said two tools comprise v-shaped tool surfaces;

inserting a stack of media into said wire element so that the stack of media does not touch said wire element; and moving said v-shaped tool surfaces closer together to force narrow loops of the wire element into holes of the media to near wide loops of the wire element;

wherein one of said two tools is a lower tool and said lower tool supports the wire element and is stationary, and wherein the other of said two tools is an upper tool and said upper tool moves downward toward the lower tool.

10. The method of claim 9, wherein said v-shaped tool surfaces are angled at 110–150 degrees.

11. The method of claim 9, wherein said v-shaped tool surfaces are angled at 136 plus or minus 3 degrees.

12. A method of inserting wire element into a stack of media and closing said wire element in holes of said stack of media, the method comprising:

positioning a wire element between two tools, wherein said two tools comprise v-shaped tool surfaces;

inserting a stack of media into said wire element so that the stack of media does not touch said wire element; and moving said v-shaped tool surfaces closer together to force narrow loops of the wire element into holes of the media to near wide loons of the wire element;

wherein, prior to moving said v-shaped tool surfaces closer together, a wire element back rest is adjusted forward or backward to position said wire element relative to said media stack.

13. A method of inserting wire element into a stack of media and closing said wire element in holes of said stack of media, the method comprising:

positioning a wire element between two tools, wherein said two tools comprise v-shaped tool surfaces;

inserting a stack of media into said wire element so that the stack of media does not touch said wire element; and moving said v-shaped tool surfaces closer together to force narrow loops of the wire element into holes of the media to near wide loops of the wire element;

wherein, prior to moving said v-shaped tool surfaces closer together, a platform, upon which said media stack is placed, is adjusted upward or downwards to position said media stack relative to said wire element.

14. A method of inserting wire element into a stack of media and closing said wire element in holes of said stack of media, the method comprising:

positioning a wire element between two tools, wherein said two tools comprise v-shaped tool surfaces;

inserting a stack of media into said wire element so that the stack of media does not touch said wire element; and moving said v-shaped tool surfaces closer together to force narrow loops of the wire element into holes of the media to near wide loops of the wire element;

wherein, prior to moving said v-shaped tool surfaces closer together, an upper wire guide is adjusted downward to cover top loops of said wire element.

* * * * *